US008939203B2

(12) United States Patent
Eslinger

(10) Patent No.: US 8,939,203 B2
(45) **Date of Patent: *Jan. 27, 2015**

(54) ENHANCING WELL FLUID RECOVERY

(71) Applicant: Schlumberger Technology Corporation, Houston, TX (US)

(72) Inventor: David Eslinger, Collinsville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/060,213

(22) Filed: Oct. 22, 2013

(65) Prior Publication Data

US 2014/0060800 A1 Mar. 6, 2014

Related U.S. Application Data

(63) Continuation of application No. 11/852,619, filed on Sep. 10, 2007, now Pat. No. 8,584,747.

(51) Int. Cl.

| | |
|---|---|
| ***E21B 43/12*** | (2006.01) |
| ***E21B 43/00*** | (2006.01) |
| ***E21B 43/25*** | (2006.01) |

(52) U.S. Cl.

CPC ..... *E21B 43/12* (2013.01); *E21B 43/003* (2013.01); *E21B 43/128* (2013.01); *E21B 43/25* (2013.01)

USPC ..... 166/249; 166/53; 166/268; 166/263; 166/177.1

(58) Field of Classification Search

USPC ..... 166/249, 263, 307, 268, 271, 370, 166/177.1, 177.5, 68, 305.1, 308.1

See application file for complete search history.

(56) References Cited

U.S. PATENT DOCUMENTS 8,584,747 B2 * 11/2013 Eslinger ..... 166/249
2009/0065197 A1 3/2009 Eslinger

* cited by examiner

*Primary Examiner* — James G Sayre
(74) *Attorney, Agent, or Firm* — Michael Stonebrook

(57) ABSTRACT

A system usable with a well includes a waveform generator for enhancing fluid recovery from a reservoir by controlling a production pump or an injection pump downhole in the well with waveform signals to create a pressure wave which propagates into the reservoir and enhances the recovery of the fluid.

15 Claims, 7 Drawing Sheets

ENHANCING WELL FLUID RECOVERY

RELATED APPLICATIONS

This patent application claims the benefit of priority to U.S. patent application Ser. No. 11/852,619 to Eslinger, filed Sep. 10, 2007, entitled "Enhancing Well Fluid Recovery," and incorporated herein by reference in its entirety.

BACKGROUND

The invention generally relates to enhancing well fluid recovery.

In general, the productivity of a reservoir increases when the reservoir has been subjected to seismic vibrational energy that is produced by an earthquake. Although the exact mechanism that causes the increased production is not well understood, the enhanced productivity has been hypothesized to be the result of the seismic vibrational energy squeezing out oil that has been bypassed in earlier recovery efforts due to reservoir heterogeneity.

Many attempts have been made to deliver vibrational energy to reservoirs for purposes of enhancing oil recovery. These attempts includes the use of surface seismic "thumping;" injected water pulses; sonic and ultrasonic devices in the wellbore; and various explosive techniques.

SUMMARY

In an embodiment of the invention, a technique that is usable with a well includes communicating fluid downhole in the well. The technique includes enhancing fluid recovery from a reservoir by, downhole in the well, controlling pumping of the fluid to create a pressure wave in the fluid, which propagates into the reservoir.

In another embodiment of the invention, a system that is usable with a well includes a downhole pump and a control subsystem. The pump communicates fluid, and the control system enhances fluid recovery from a reservoir by controlling the pump to create a pressure wave, which propagates into the reservoir.

In another embodiment of the invention, a system that is usable with a well includes a string and a control subsystem. The string includes an artificial lift system to communicate well fluid that is produced from a reservoir to the surface of the well. The artificial lift system includes a pump; and the control subsystem enhances fluid recovery from the reservoir by controlling the pump to create a cyclic reflected pressure wave, which propagates into the reservoir.

In yet another embodiment of the invention, a technique includes injecting a fluid into the first well, which includes operating a downhole pump. The technique includes controlling operation of the downhole pump to enhance fluid recovery from at least one additional well located near the first well. The enhancement includes controlling the operation of the pump to create a pressure wave, which propagates into a reservoir that is in communication with the additional well(s).

Advantages and other features of the invention will become apparent from the following drawing, description and claims This summary section is not intended to give a full description of electric submersible pump cables for harsh environments. A detailed description with example embodiments follows.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
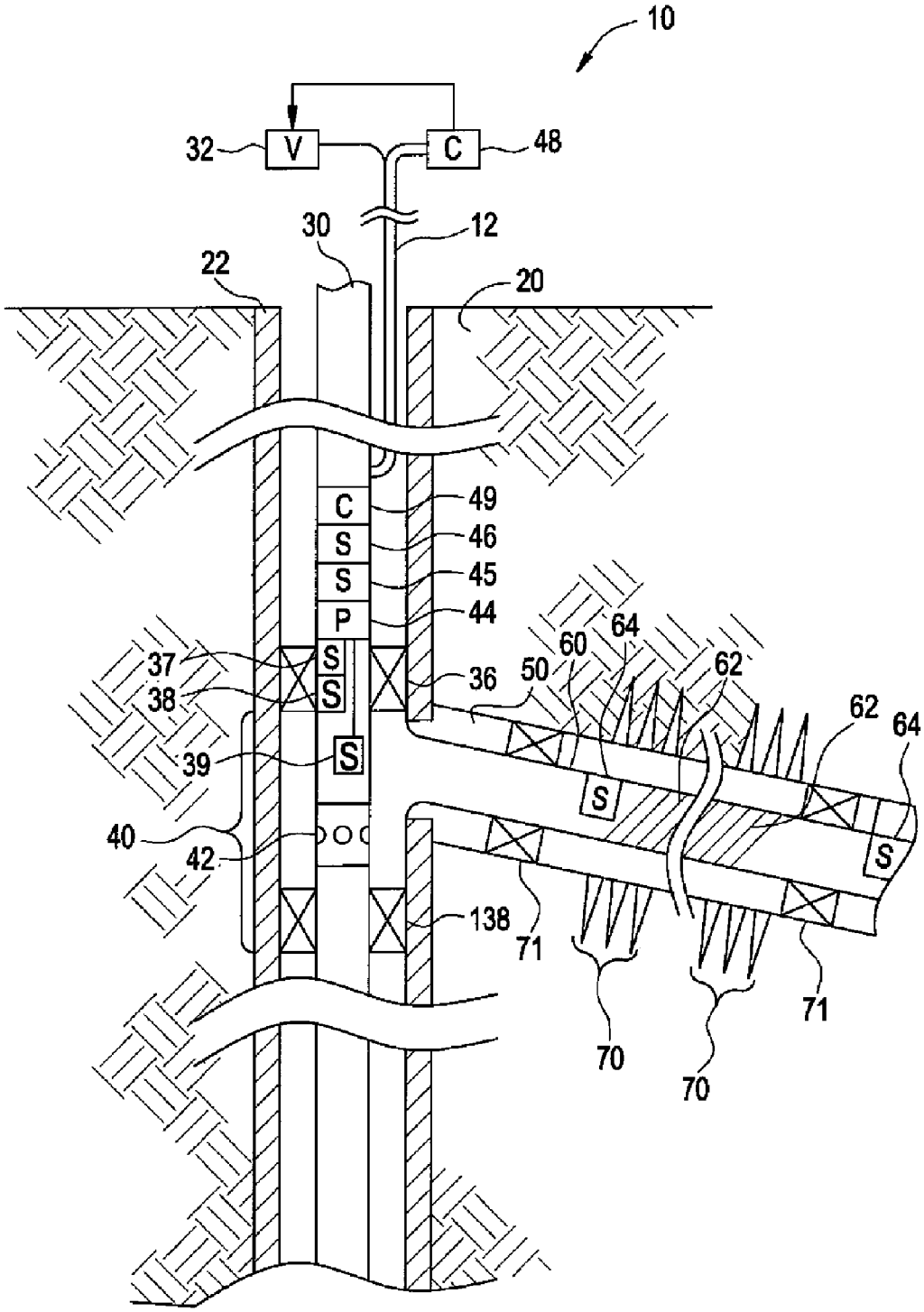
FIG. 1 is a schematic diagram of a well according to an embodiment of the invention.

Referring to FIG. 1, an embodiment 10 of a well (a subsea or subterranean well) in accordance with the invention includes a main or vertical wellbore 20 that is lined and supported by a casing string 22. It is noted that the wellbore 20 may be uncased in accordance with other embodiments of the invention. The well 10 includes a tubular string 30 that extends downhole inside the wellbore 20 and establishes at least one zone 40 in which the string 30 receives well fluid that is communicated by the string 30 to the surface of the well 10.

The zone 40 may be created, for example, between upper 36 and lower 138 packers that form corresponding annular seals between the tubular string 30 and the interior of the casing string 22 (assuming that the well 10 is cased). Incoming well fluid flows into a valve, such as a circulation valve 42, of the string 30 and is communicated to the surface of the well via the string's central passageway.

In accordance with embodiments of the invention described herein, the well 10 includes an artificial lift system that includes at least one downhole pump 44 (an electrical submersible pump (ESP) or a progressive cavity pump (PCP), as just a few non-limiting examples), which may be part of the string 30. More specifically, in accordance with embodiments of the invention, a power cable 12 extends downhole to communicate power (three phase power, for example) to the pump 44 for purposes of lifting produced well fluid from the zone 40 through the string 30 to the surface of the well 10.

In accordance with some embodiments of the invention, a surface-located motor variable speed drive (VSD) controller 32 controls the speed of the pump 44 by controlling the power that is communicated downhole to the pump 44 via the power cable 12. The VSD controller 32, in turn, is controlled by a surface controller 48, which may receive pressure data (as further described below) from downhole, which is encoded on the power cable 12. Based on the pressure data and possibly other data (as further described below), the surface controller 48 communicates with the VSD controller 32 for purposes of varying the speed of the pump 44.

As described in more detail below, for purposes of enhancing oil recovery, the pump 44 is controlled in a manner to produce a reflected, cyclic pressure wave that propagates into the well's reservoir(s). As a non-limiting example, the pressure wave may have frequency of around 0.10 Hertz (Hz) and may have an amplitude on the order of 50 pounds per square inch (psi), in accordance with some embodiments of the invention. This pressure wave delivers vibrational energy into the reservoir(s) of the well 10, which enhances oil recovery from the reservoirs). Because the power of the pump 44 may be on the order of several hundred horsepower (hp), the pressure wave may be relatively powerful (as compared to conventional mechanisms to generate vibrational energy); and thus, the pump 44 is quite effective at delivering vibrational energy to the reservoir(s).

As a more specific example, in accordance with some embodiments of the invention, the fluid that is received in the zone 40 may be produced from various perforated production zones 70 of a lateral or deviated wellbore 50. Depending on the particular embodiment of the invention, each production zone 70 may be established between packers 71 that form annular seals between a sand screen assembly 60 and the wellbore wall. In each zone 70, the sand screen assembly 60 may include, for example, two isolation packers 71 as well as a sand screen 62. In general, the sand screen 62 filters incoming particulates from the produced well fluid so that the filtered well fluid flows into the central passageway of the sand screen assembly 60 and flows into the zone 40, where the well fluid is received into the central passageway of the tubular string 30.

In accordance with embodiments of the invention described herein, in the course of producing fluid from the well 10, the well fluid flows from the zone 70, into the zone 40, into the central passageway of the tubular string 30 and then to the surface of the well 10 via the pumping action of the pump 44.

It is noted that the well 10 that is depicted in FIG. 1 is exemplary in nature, in that the pump 44 and associated control techniques that are disclosed herein, may likewise be applied in other wells. For example, the production zones of the well may alternatively be located in the main wellbore 20 below the pump 44. As another example, the well may instead be an injection well. Thus, many variations are contemplated and are within the scope of the appended claims.

As an example, the speed of the pumping (i.e., the rotational speed of the pump's motor) may be continually varied to continually vary the momentum of the pumped fluid, an action that creates a reflected cyclic pressure wave to deliver the vibrational energy to the reservoir(s).

Figure 2:
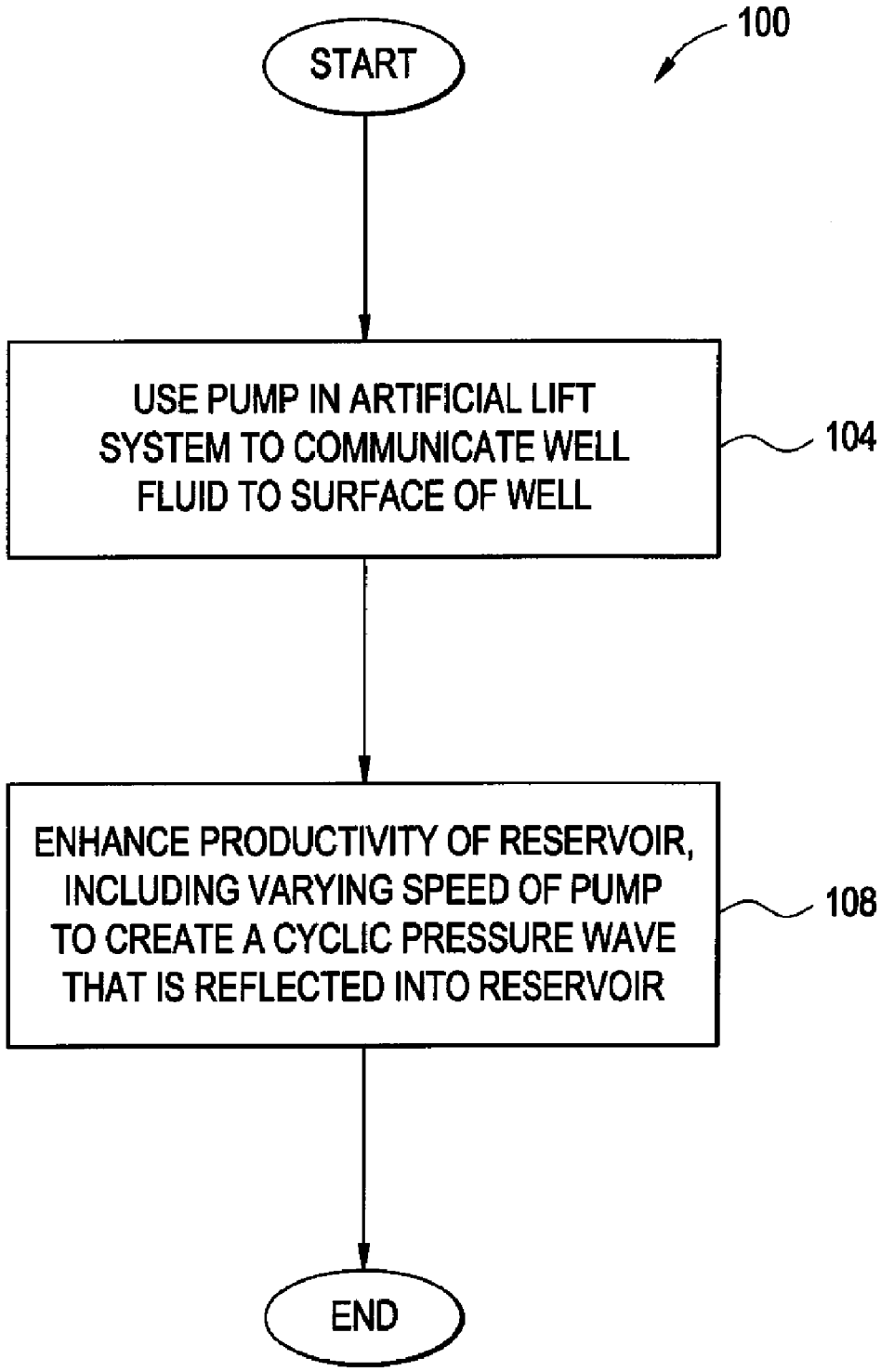
FIGS. 2, 3, 5 and 6 are flow diagrams depicting techniques to enhance fluid recovery from a reservoir according to embodiments of the invention.

Thus, referring to FIG. 2 in conjunction with FIG. 1, a technique 100 in accordance with the invention includes using a pump in an artificial lift system to communicate well fluid to the surface of a well, pursuant to block 104. The technique 100 includes enhancing (block 108) the recovery of fluid from the reservoir. This enhancement includes varying the speed of the pump to create a reflected cyclic pressure wave that propagates into the reservoir.

It is noted that in other embodiments of the invention, the pumping speed of the pump 44 may be varied pursuant to a variety of possible periodic functions (a pure sinusoid, an on-off pulse train sequence, etc., for example) for purposes of creating a time-varying periodic pressure wave. However, the pumping speed of the pump 44 may be varied in a non-periodic fashion in accordance with other embodiments of the invention.

For example, in other embodiments of the invention, the pumping may be intermittingly sped up or slowed down at non-periodic intervals. As another example, in other embodiments of the invention, the pumping may be relatively constant until a determination is made (based on a model, downhole measurements, etc.) that vibrational energy needs to be generated to enhance the well's production. At that time, the speed of the pump may be varied to generate the vibrational energy. Thus, many variations are contemplated and are within the scope of the appended claims.

For embodiments of the invention in which a cyclic pressure wave is created, the cyclic pressure wave has an associated amplitude and frequency. The pressure wave's amplitude is a measure of the wave's power, and it has been determined that, in general, a pressure amplitude around 50 psi but as large as 200 psi enhances the recovery of oil from the reservoir. Also, in general, it has been determined that with a frequency of less than approximately 1 Hz the oil recovery is enhanced. It is noted however, that these amplitudes and frequencies are merely provided for purposes of example, as other amplitudes and frequencies are contemplated and are within the scope of the appended claims.

In order to "tune" the reflected pressure wave, the well 10 in accordance with embodiments of the invention, includes at least one sensor for purposes of monitoring the generation of the pressure wave and/or monitoring the pressure at the perforation interface. In this manner, a controller 49 (see FIG. 1), which may be located in the tubular string 30, for example, may monitor the produced pressure wave (via sensors described further below) and communicate encoded pressure data to the surface controller 48 for purposes of controlling the pump 44 until the pressure wave at the perforation interface is optimized. The control of the pump 44 may also varied until a desired sandface pressure (the total pressure at the perforation interface) is achieved. In this regard, the sandface pressure is at least one measure of the well's productivity, and in accordance with some embodiments of the invention, the controller 48 may vary the control of the pump 44 for purposes of maximizing the sandface pressure.

As a more specific example, the controller 48 may generate an oscillating component of a pump control signal to control the pump's speed; and depending on the actual pressure wave that is indicated by the one or more sensor-based measurements, the controller 48 may change the control signal to decrease or increase the amplitude of the pressure wave, change the frequency of the wave; etc. The parameters (frequency, amplitude, pressure-time waveform, etc.) for the desired pressure wave may be based on calculations, empirical data and/or ongoing measurements of the well's productivity as a function of the measured pressure wave characteristics (such as frequency and amplitude). Thus, many variations are contemplated and are within the scope of the appended claims In accordance with some embodiments of the invention, the controller 48 controls the speed of the pump's motor based on one or more pressure measurements that are acquired downhole in the well. More specifically, in accordance with some embodiments of the invention, the well 10 includes sensors 37, 39, 46 and 64 (pressure sensors, for example), which provide indications of a pressure at the intake of the pump 44 (via sensor 37), discharge outlet of the pump 44 (via the sensor 46) and a bottom hole pressure (via the sensors 64 or 39). In some embodiments of the invention, the well 10 includes a sensor 64 in each zone 70 so that the controller 48 may adjust the control of the pump 44 according to the wave that propagates into each of the zones 70.

Additionally, in some embodiments of the invention, vibration sensors may be located on the pump 44 (such as a pump discharge vibration sensor 45 and a pump intake vibration sensor 38, as examples) to provide information to the controller 48 showing the effect of the pump speed signature on pump mechanical vibration.

Figure 3:
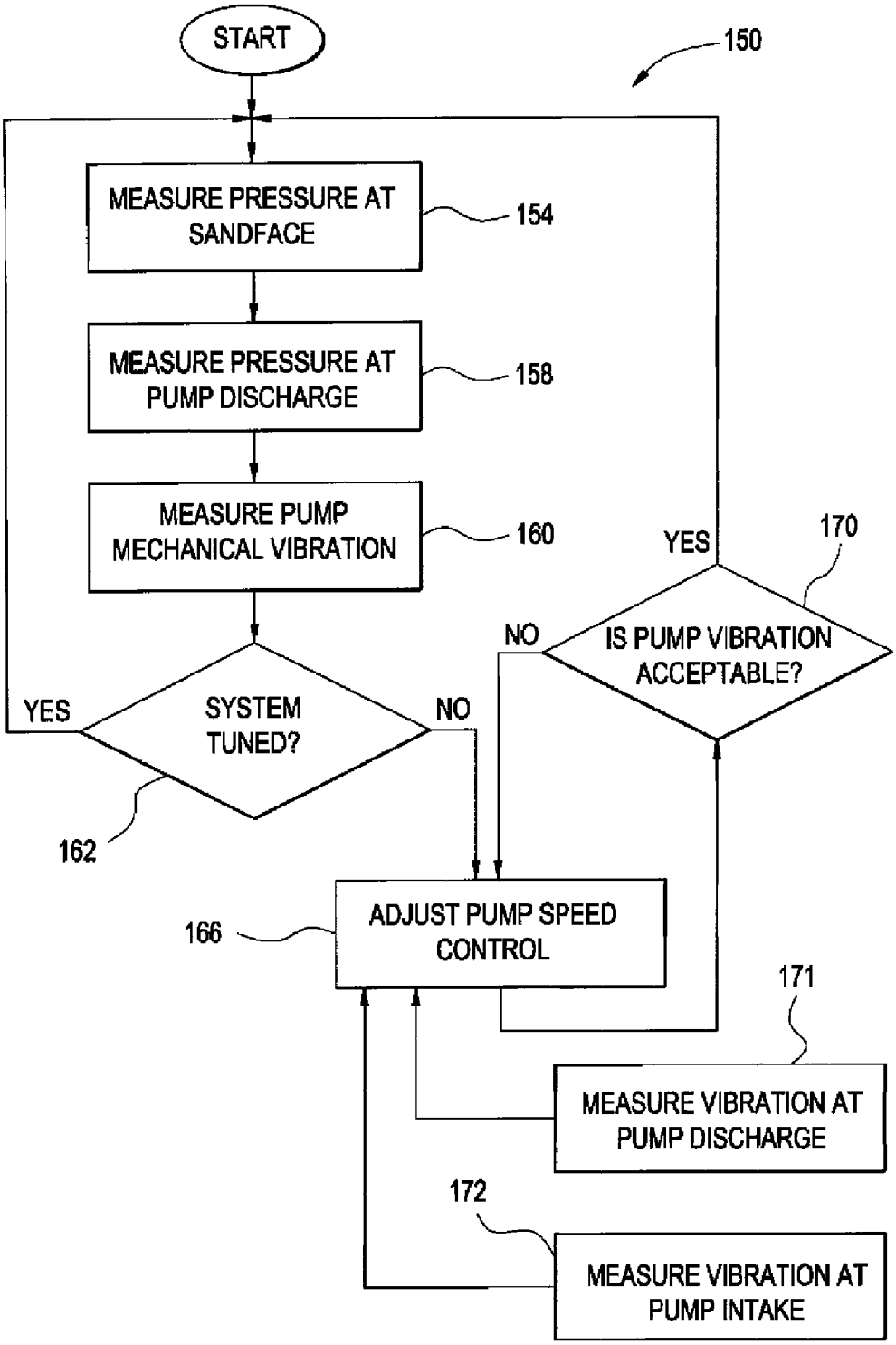

To summarize, FIG. 3 depicts a technique 150 that may be used in accordance with some embodiments of the invention for purposes of adaptively controlling the pump 44 on a relatively short time scale (a time scale less than a day, for example). Pursuant to the technique 150, the sandface pressure is measured (block 154), and the pressure is measured (block 158) at the pump discharge. Also, the pump mechanical vibration may be measured, pursuant to block 160. Based on these measurements, a determination is made (diamond 162) whether the system is tuned. If not, the pump speed control is adjusted, pursuant to block 166. The pump mechanical vibration signals from the pump discharge (block 171) and pump intake (block 172) may also be measured, and a determination is made (diamond 170) whether it is safe to operate the pump 44 at the new speed signature. If the operation is not safe, the pump speed control is adjusted pursuant to block 166. Control then returns to block 154 for purposes of the continued monitoring and if needed, adjustment of the pump speed.

It is noted that the pump control system may be autonomous or may be controlled from the surface of the well 10, depending on the particular embodiment of the invention. For example, in accordance with some embodiments of the invention, the pressure measurements may be communicated to the surface of the well (via wired or wireless communication) so that the speed of the pump 44 may be controlled manually by an operator or automatically by a controller at the surface. In other embodiments of the invention, such as embodiments in which a hydraulically-driven pump is used, the surface-based control may be moved downhole in the well. Thus, many variations are contemplated and are within the scope of the appended claims.

Figure 4:
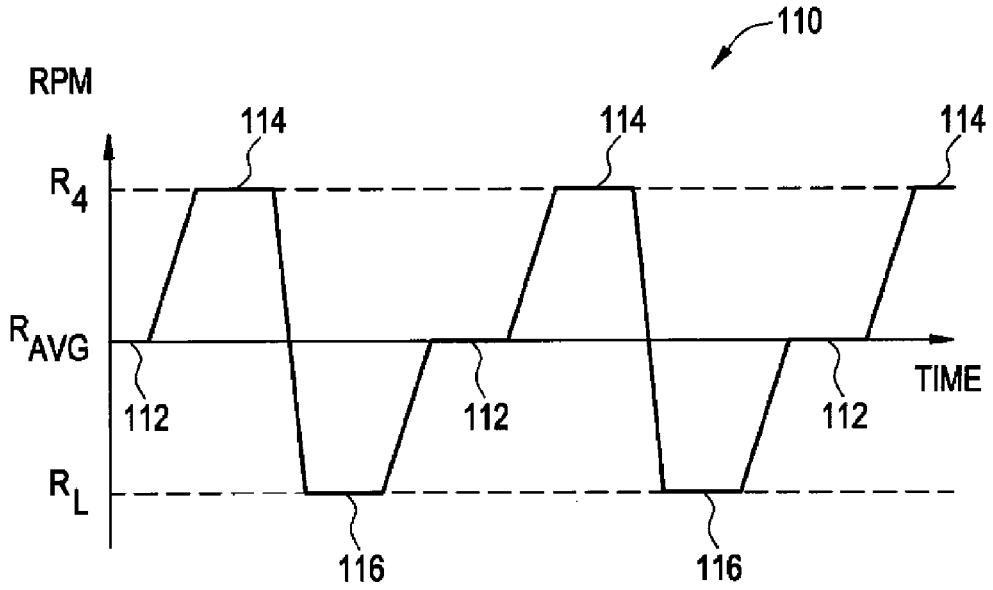
FIG. 4 is a waveform depicting a speed of a pump motor of FIG. 1 according to an embodiment of the invention.

FIG. 4 depicts an exemplary waveform 110 of the pump motor speed over time, in accordance with some embodiments of the invention, for purposes of creating a cyclic pressure wave that propagates into the reservoir(s) of the well 10. The speed of the motor has an average value (called "R.sub.AVG," in FIG. 4) and a slowly varying cyclic component that varies between an upper speed threshold (called "R.sub.H" in FIG. 4) and a lower speed threshold (called "R.sub.L" in FIG. 4). Therefore, the speed has segments 112 in which the speed remains at the average speed R.sub.AVG; segments 114 in which the speed remains at the upper speed threshold R.sub.H speed; and segments 116 in which the speed remains at the lower speed threshold R.sub.L.

As a more specific example, in accordance with some embodiments of the invention, the waveform has a frequency between approximately 0.05 to 0.2 Hertz (3 to 12 cycles/minute), and the amplitude of the waveform 110 is approximately ten percent of the average speed R.sub.AVG. Thus, for example, if the average speed R.sub.AVG of the pump 44 is 3500 revolutions per minute (rpm) (as a non-limiting example), then the upper speed threshold R.sub.H is approximately 3850 rpm, and the lower speed threshold R.sub.L is approximately 3150 rpm.

Figure 5:
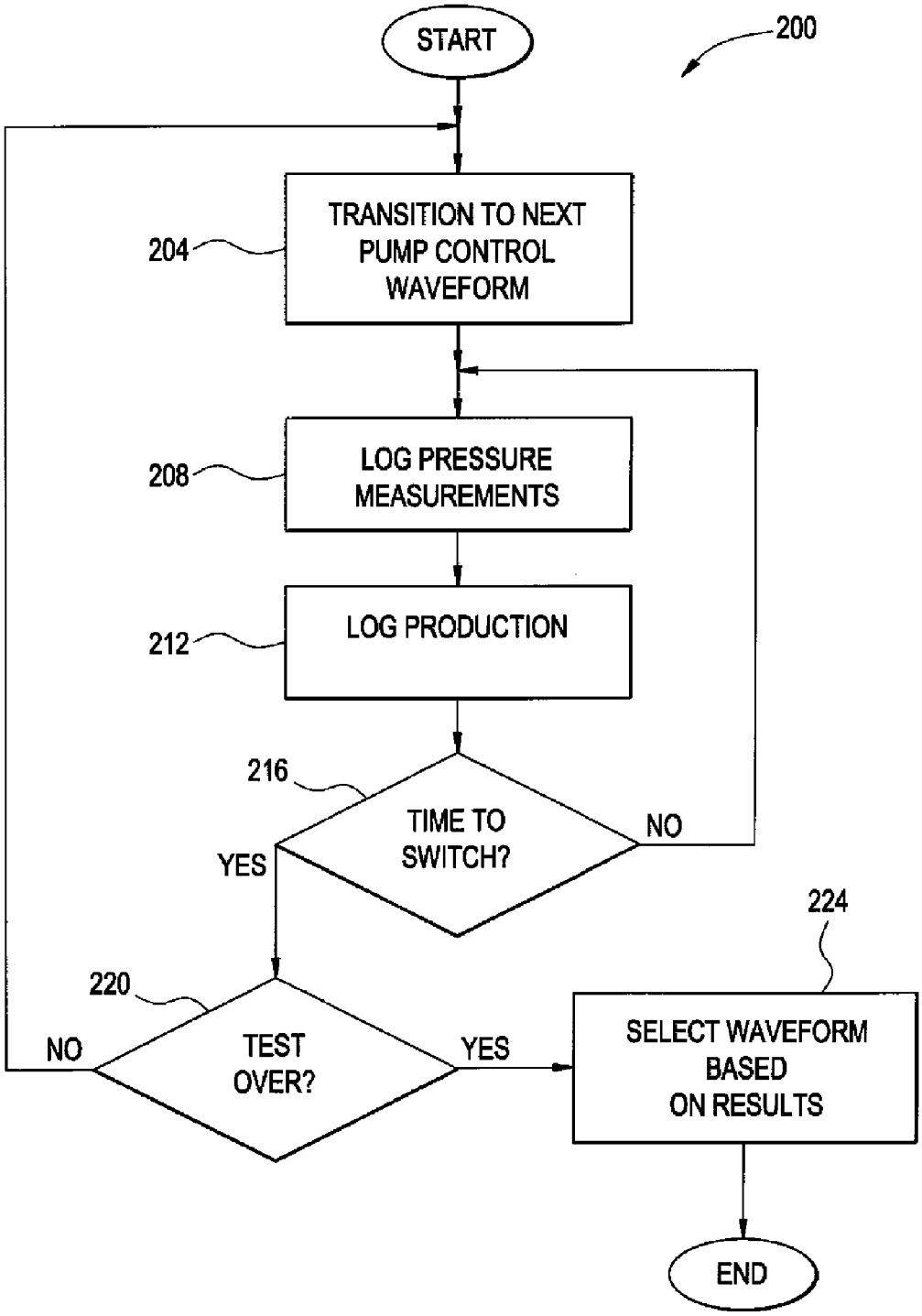

Maximizing the bottom hole pressure may not necessarily yield the highest well productivity. Furthermore, the particular waveform for controlling the pump speed 44 may depend on the particular downhole environment and a host of other factors that may not be easy to predict. For purposes of determining the optimal speed control for the pump 44 a technique, such as a technique 200 that is depicted in FIG. 5, may be used in accordance with some embodiments of the invention. The technique 200 is an adaptive technique that may be performed over a longer time scale (a time scale of several days, for example), as compared to the technique 150 of FIG. 3, and may involve a "sweep" of a wide variety of possible motor control schemes for the pump 44 for purposes of determining the optimal control scheme for the pump 44. In this regard, the technique 200 involves testing over a set of time intervals; changing the speed control for the pump 44 at the beginning of each time interval (every day, as an example); and observing the results (productivity, downhole measurements etc.).

More specifically, in accordance with embodiments of the invention, the technique 200 includes transitioning (block 204) to the next pump control waveform (e.g., a waveform having a different frequency, amplitude, voltage-time profile, etc., than the other waveforms). The transitioning may occur, for example, on a daily basis during the test. Next, such parameters as pressure (block 208) and well fluid production (212) are logged during the interval. When a determination is made (diamond 216) that the current interval is over (i.e., the beginning of the next day, for example), then a determination is made (diamond 220) whether the test is complete. If so, the pump control waveform that produced the best results (the highest production, for example) is selected, pursuant to block 224. Otherwise, a transition is made to the next pump control waveform, pursuant to block 204.

Figure 6:
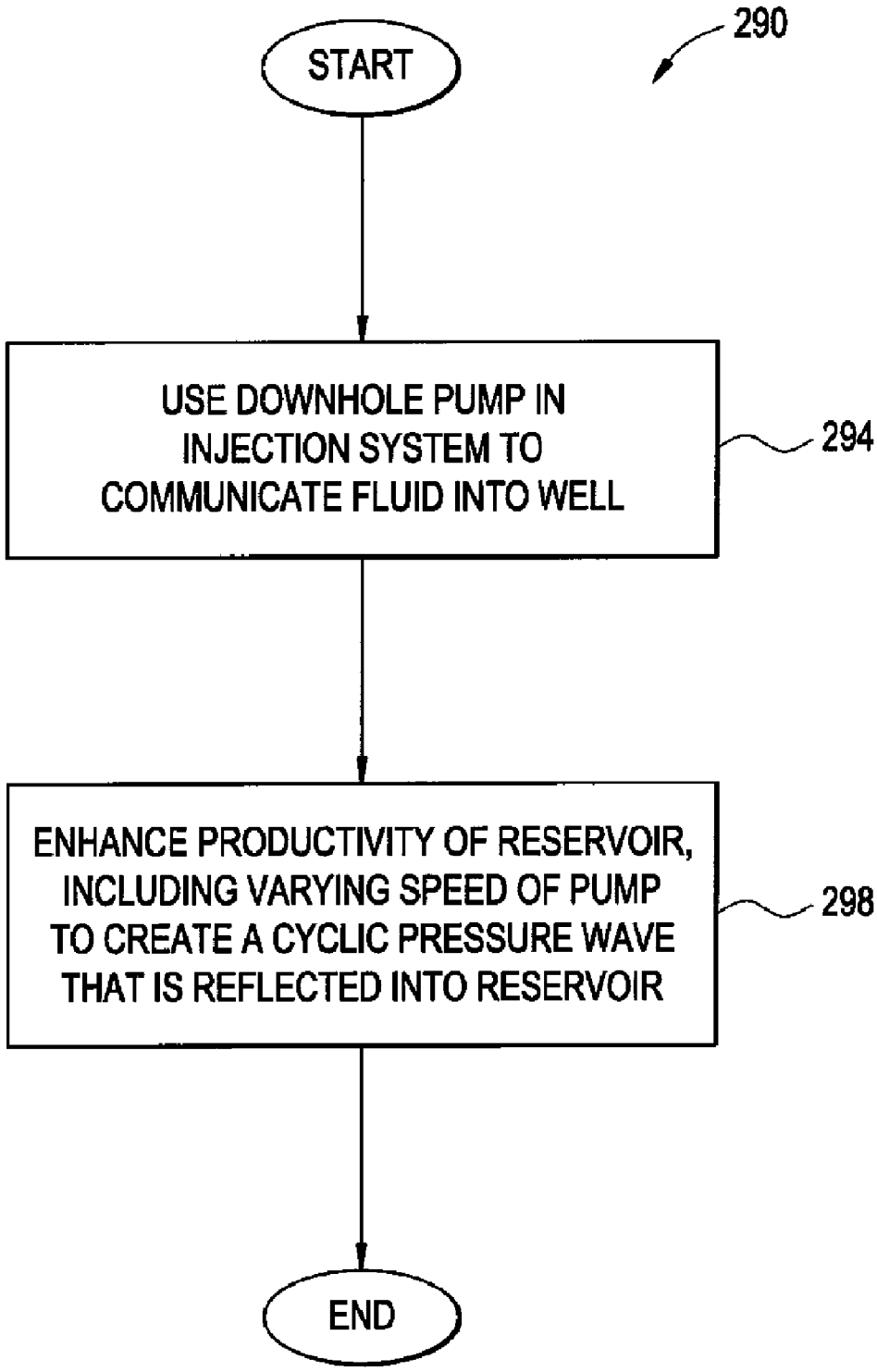

In accordance with some embodiments of the invention, the techniques that are described herein may be used in injector wells. Thus, the techniques are also applicable to increasing injectivity of injector wells, i.e., reducing injection pressure. In accordance with these embodiments of the invention, a technique 290 (see FIG. 6) includes using (block 294) a downhole pump in an injection system to communicate fluid into the well. The technique 290 includes enhancing (block 298) the productivity of the reservoir, which includes varying the speed of the pump to create a cyclic pressure wave that is reflected into the reservoir.

Figure 7:
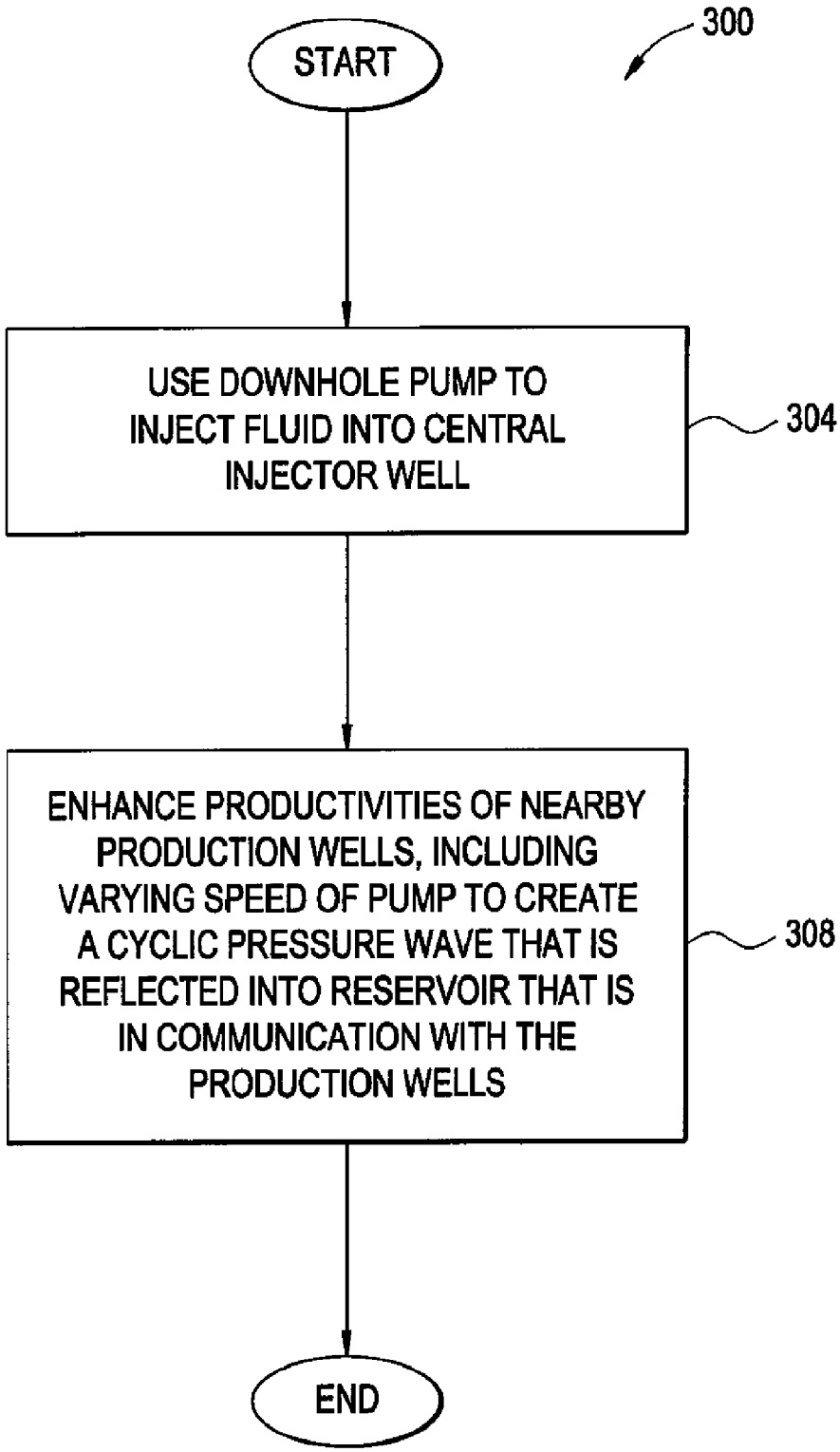
FIG. 7 is a flow diagram of a technique to enhance fluid recovery from production wells by controlling a pumping operation in a nearby injection well according to an embodiment of the invention.

As another example of an additional embodiment of the invention, the techniques that are described herein may be used in an injector well for purposes of improving the production of surrounding production wells. In other words, a cyclic, reflected pressure wave may be created in the injector well and used for purposes of stimulating nearby surrounding production wells such as, for example, production wells that are located within a certain radius (within a one mile radius, for example) of the injector well. More specifically, referring to FIG. 7, a technique 300 includes using (block 304) a downhole pump to inject fluid into a central injector well and enhancing (block 308) the productivities of nearby production wells. The enhancement of the productivity includes varying the speed of the pump to create a cyclic pressure wave that is reflected into a reservoir.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

Conclusion

Although only a few example embodiments have been described in detail above, those skilled in the art will readily appreciate that many modifications are possible in the example embodiments without materially departing from the subject matter. Accordingly, all such modifications are intended to be included within the scope of this disclosure as defined in the following claims In the claims, means-plus-function clauses are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

The invention claimed is:

1. A system, comprising:

a pump disposed downhole in a well to create a fluid flow of a pumped fluid through the pump between an Earth surface of the well and a reservoir;

a variable speed drive to control a rotational speed of a motor of the pump;

a controller operatively connected to the variable speed drive for enhancing a fluid recovery from the reservoir;

a control logic in the controller to continually vary a rotational speed of the motor of the pump;

the control logic controlling the motor to continually vary a momentum of the pumped fluid inside a pump housing of the pump and inside a production tubing connected to the pump to create reflected cyclic pressure waves against the pump housing and the production tubing;

the pump housing and the production tubing transmitting the pressure waves into the reservoir; and a vibrational energy of the pressure waves enhancing the fluid recovery.

2. The system of claim 1, further comprising at least one pressure sensor disposed downhole in the well and communicatively coupled with the controller, wherein the controller varies a momentum of the pumped fluid inside a pump housing of the pump and inside a production tubing connected to the pump to create reflected cyclic pressure waves against the pump housing and the production tubing, based on at least a pressure datum from the pressure sensor.

3. The method of claim 2, wherein the at least one pressure datum comprises an indication of a pressure at an outlet of the pump, an intake of the pump, or a sandface pressure.

4. The system of claim 1, wherein the fluid comprises injection fluid.

5. The system of claim 1, wherein the pressure wave incident upon the reservoir has a pressure amplitude of approximately between 50-200 pounds per square inch (psi) and a frequency of less than approximately 1 Hertz, to deliver vibrational energy to the reservoir.

6. The system claim 1, further comprising a vibration sensor communicatively coupled with the controller;

wherein the vibration sensor measures a vibration of the pump; and the controller tunes the measured vibration according to a feedback loop to maximize a sandface pressure of the well as conditions in the reservoir change.

7. The system of claim 1, wherein the controller varies the speed of the pump at a frequency of approximately 0.02 to 0.5 Hertz over a sequence of different waveforms.

8. A waveform generator, comprising:

a waveform generation logic to create a waveform signal for controlling a motor of a downhole pump;

a connector for transmitting the waveform signal to a speed controller of the motor;

the waveform generation logic varying a speed of the downhole pump to create changes in a fluid momentum of a fluid being pumped within the downhole pump resulting in pressure waves inside the downhole pump;

wherein a housing of the downhole pump transmits the pressure waves created by the changes in fluid momentum into the reservoir to increase a flow of a hydrocarbon from the reservoir.

9. The waveform generator of claim 8, wherein the fluid comprises well fluid, and the downhole pump is part of a lift system to communicate the well fluid to the surface of the well.

10. The waveform generator of claim 8, wherein the fluid comprises an injection fluid, and the downhole pump is part of an injection system to inject the fluid into the well.

11. The waveform generator of claim 8, wherein the pressure waves have a pressure amplitude of approximately between 50-200 pounds per square inch (psi) and a frequency of less than approximately 1 Hertz.

12. The waveform generator of claim 8, wherein the downhole pump comprises an electrical submersible pump or a progressive cavity pump.

13. The waveform generator of claim 8, further comprising a connection to at least one sensor to measure at least one characteristic of the well fluid;

wherein the waveform generator tunes the waveform controlling the motor based on ongoing changes in the at least one characteristic.

14. The waveform generator of claim 13, wherein the at least one sensor comprises a pressure sensor or a vibration sensor.

15. The waveform generator of claim 14, wherein the at least one sensor comprises a pressure sensor to measure a pressure of the well fluid, a pressure at an outlet of the pump, a pressure at an intake of the pump, or a sandface pressure.

* * * * *